US006039233A

United States Patent [19]

Kalbach

[11] Patent Number: 6,039,233

[45] Date of Patent: Mar. 21, 2000

[54] WIRE MESH STAPLER DEVICE

[76] Inventor: Robert J. Kalbach, 1543 Marshalton Thorndale Rd., Dowingtown, Pa. 19335

[21] Appl. No.: 09/104,818

[22] Filed: Jun. 25, 1998

[51] Int. Cl.[7] ..... B25C 5/00

[52] U.S. Cl. ..... 227/176.1; 227/85; 227/120; 227/143

[58] Field of Search ..... 227/176.1, 120, 227/143, 156, 85, 132; 29/243.56; 72/409.01, 409.03, 409.04, 409.05, 409.11

[56] References Cited

U.S. PATENT DOCUMENTS

| | | | |
|---|---|---|---|
| 2,195,889 | 4/1940 | Maynard | 227/85 |
| 4,284,223 | 8/1981 | Salcido et al. | 227/132 |
| 4,369,909 | 1/1983 | Grzeika | 227/132 |
| 4,682,412 | 7/1987 | Pfeffer | 227/132 |
| 5,398,861 | 3/1995 | Green | 227/132 |

*Primary Examiner*—Peter Vo
*Assistant Examiner*—Jim Calve
*Attorney, Agent, or Firm*—Henderson & Sturm LLP

[57] ABSTRACT

A wire mesh stapling device 10 including a pair of handle members 20 pivotally secured together as at 27 by a fastening element 42 which is connected to a bracket member 40 having a lower end 44 which is pivotally secured to a staple feeding magazine 50 for feeding staples 100 to the jaw element 30 on the lower end of the lower arm portions 22 of each of the handle members 20.

3 Claims, 2 Drawing Sheets

WIRE MESH STAPLER DEVICE

REFERENCE TO MICROFICHE APPENDIX

Not applicable.

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to the field of staple driving devices in general, and in particular to a long handled stapler device specifically designed to attach wire staples to join together sheets of concrete reinforcing mesh.

2. Description of Related Art

As can be seen by reference to the following U.S. Pat. Nos. 4,284,223; 4,369,909; 4,682,412; 5,398,861 the prior art is replete with myriad and diverse stapling devices.

While all of the aforementioned prior art constructions are more than adequate for the basic purpose and function for which they have been specifically designed, they are uniformly deficient with respect to their failure to provide a simple, efficient, and practical wire mesh stapling device that can be used to join sections of wire mesh fencing together in the fabrication and erection of a fence.

As anyone in the construction industry is all too well aware, one of the most time consuming and labor intensive aspects of fabricating mesh reinforcement for concrete involves the joining of sections of wire mesh together to create a running length of mesh fabric to be embedded in concrete.

As a consequence of the foregoing situation, there has existed a longstanding need for a new and improved wire mesh stapling device that employs a long handled tool that one person can operate to connect wire staples to adjacent sections of wire mesh to create running lengths of concrete reinforcing fabric, and the provision of such a construction is a stated objective of the present invention.

BRIEF SUMMARY OF THE INVENTION

Briefly stated, the wire mesh stapler device that forms the basis of the present invention comprises in general a pivoted handle unit, a mounting unit operatively associated with the pivoted handle unit, and a staple feeding unit pivotally associated with the mounting unit.

As will be explained in greater detail further on in the specification, the mounting unit comprises an elongated mounting bracket operatively connected to the pivoted handle members of the handle unit wherein the upper end of the mounting bracket is provided with a clip unit dimensioned to releasably receive the staple feeding unit and the lower end of the mounting bracket is provided with a clamp element that is pivotally connected to the staple feeding unit. The staple feeding unit will feed wire staples to the jaw elements on the lower end of the handle members so that sections of wire mesh can be quickly and easily joined together to form a running length of concrete reinforcing fabric.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
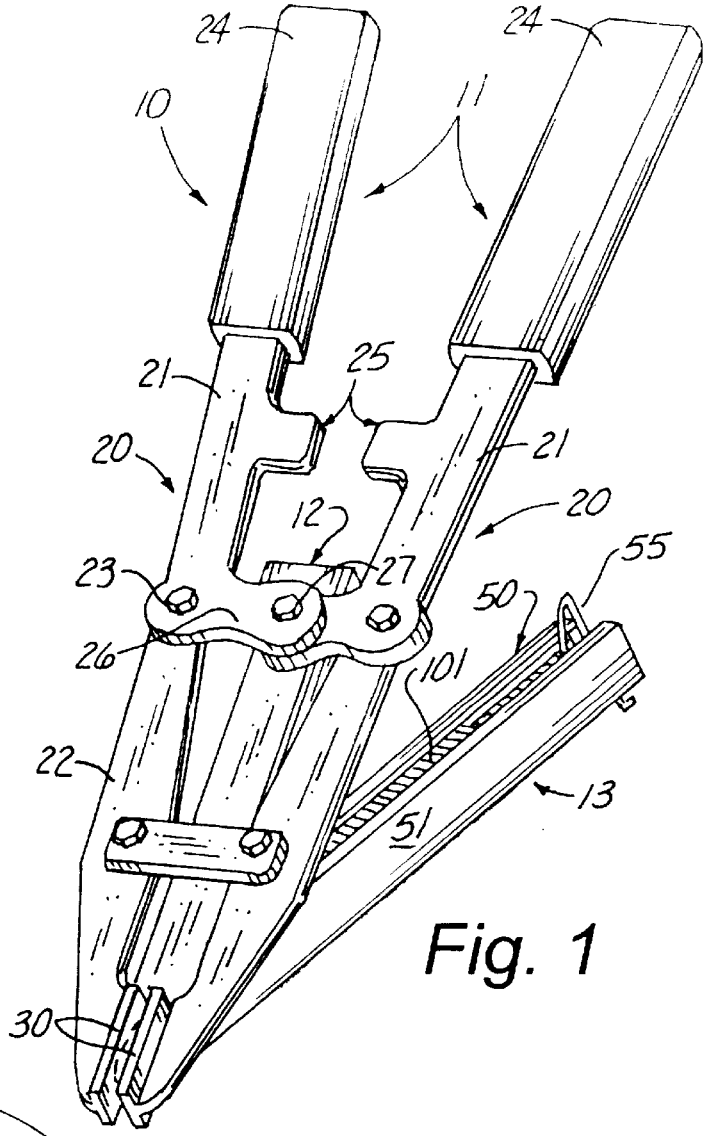
FIG. 1 is a perspective view of the stapler device that forms the basis of the present invention.

As can be seen by reference to the drawings, and in particularly to FIG. 1, the wire mesh stapler device that forms the basis of the present invention is designated generally by the reference number 10. The stapler device 10 comprises in general a handle unit 11, a mounting unit 12, and a staple feeding unit 13. These units will now be described in seriatim fashion.

Figure 4:
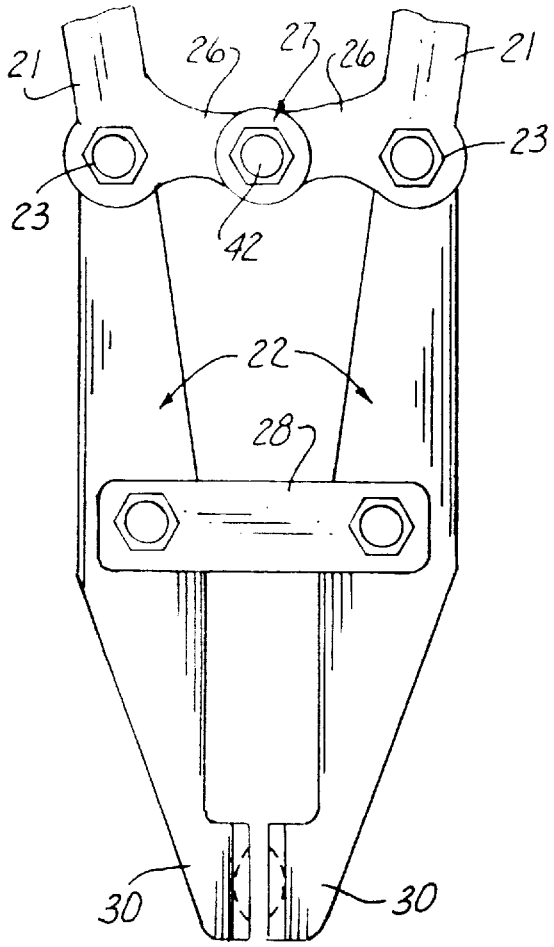
FIG. 4 is an isolated detail view of the lower end of the handle members disposed in the closed position.
Figure 5:
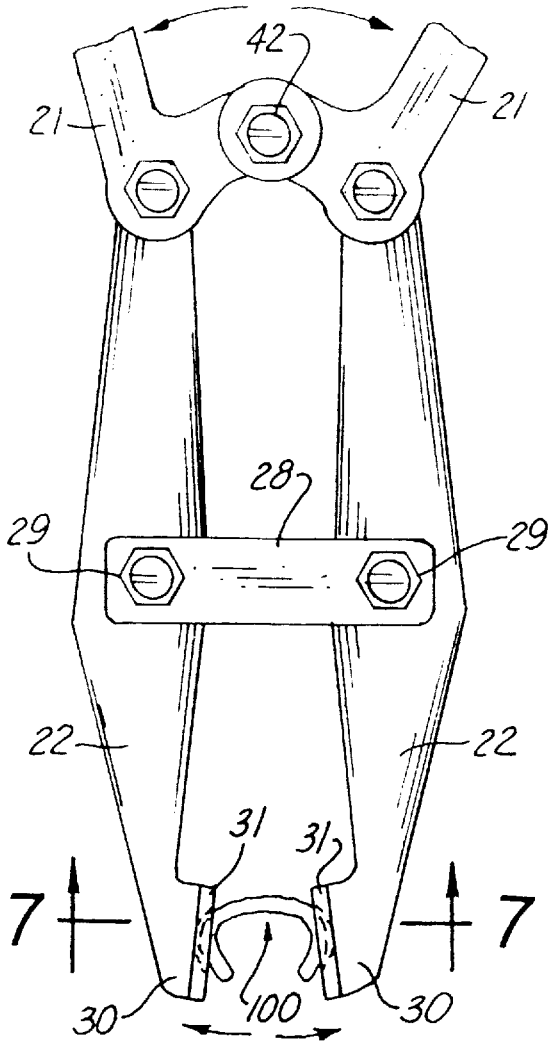
FIG. 5 is an isolated detail view of the lower end of the handle members in the staple engaging position.
Figure 7:
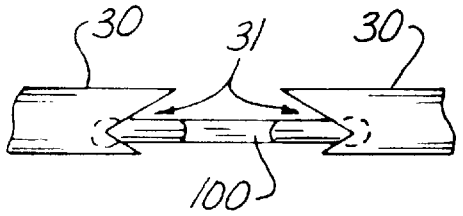
FIG. 7 is a cross sectional view taken through line 7—7 of FIG. 5.
Figure 6:
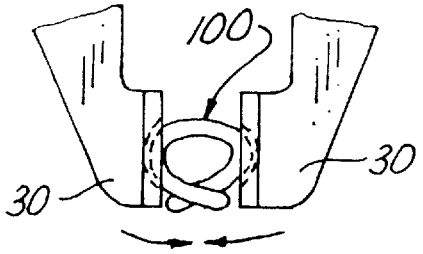
FIG. 6 is an isolated detail view of the handle jaws closing a staple.

As shown in FIGS. 1, 4 and 5, the handle unit 11 comprises a pair of mirror image handle members 20 each having an upper arm portion 21 pivotally secured to a lower arm portion 22 as at 23.

In addition, the upper arm portion 21 of each of the handle members 20 are provided with an upper hand grip element 24, an intermediate inwardly projecting stop element 25 and a lower inwardly projecting pivot arm 26 wherein the inboard end of each of the pivot arms 26 are pivotally connected to one another as at 27.

Furthermore, as can best be seen by reference to FIGS. 4 through 7, each of the lower arm portions 22 are further operatively connected to one another by a cross piece member 28 which is pivotally secured on the opposite ends as at 29 proximate the midpoint of the lower arm portion 22 of each handle member 20. The bottom of each lower arm portion 22 is provided with an inwardly directed jaw element 30 having a notched jaw recess 31 dimensioned to receive one side of a wire staple 100.

Figure 3:
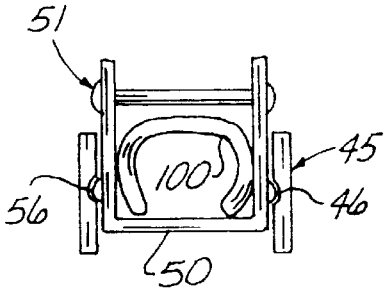
FIG. 3 is a cross sectional view taken through line 3—3 of FIG. 2.
Figure 2:
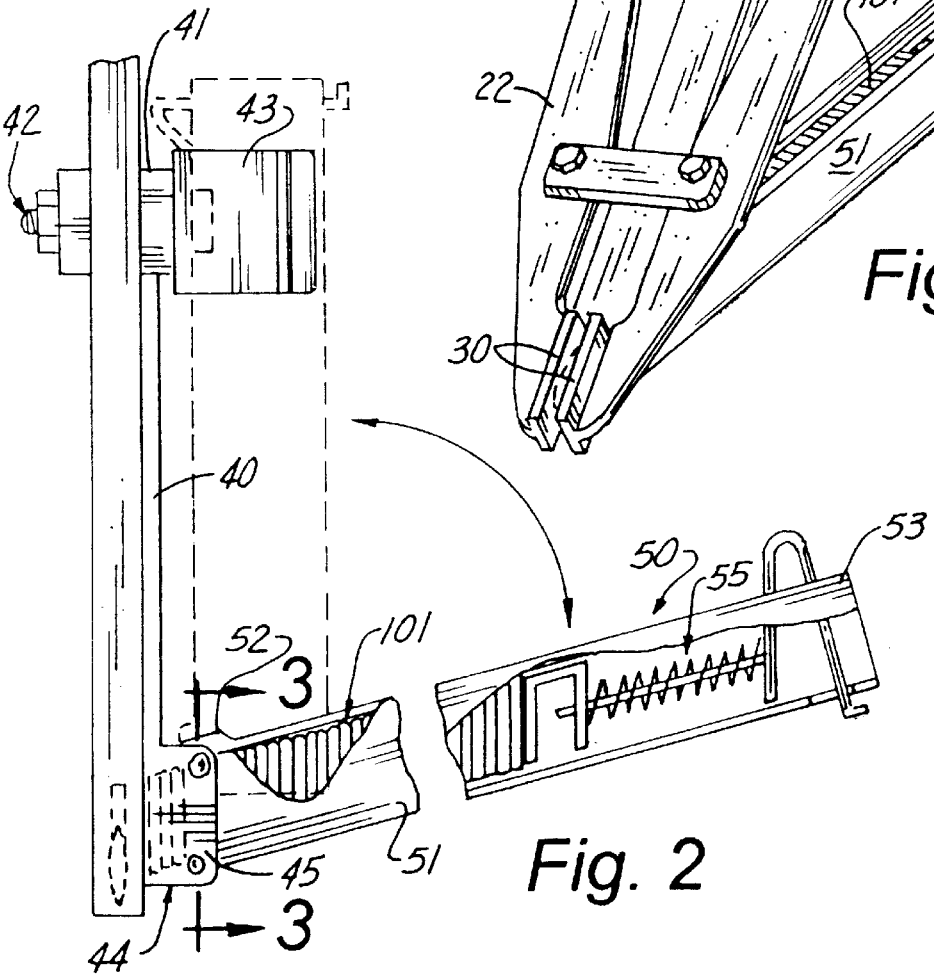
FIG. 2 is a side plan view of the stapler device.

Turning now to FIGS. 1 through 3, it can be seen that the mounting unit 12 comprises an elongated mounting bracket 40 wherein the upper end 41 of the mounting bracket 40 is fixedly secured to the handle members 20 via a fastening element 42 which functions as a pivot element for the inwardly projecting pivot arms 26 on the lower end of the upper arm portion 21 of each handle member 20.

In addition, the upper end 41 of the mounting bracket 40 is further provided with a generally U-shaped clip element 43 and the lower end 44 of the mounting bracket 40 is provided with a generally U-shaped clamp element 45 provided with a pair of opposed internal recesses 46. The purpose and function of the U-shaped clip 43 and clamp 45 elements will be described presently.

Still referring to FIGS. 1 through 3, it can be seen that the staple feeding unit 13 comprises in general an elongated staple feeding magazine 50 including a magazine housing 51 pivotally secured on one end 52 to the clamp element 45 of the mounting bracket 40. The other end 53 of the magazine housing 51 is dimensioned to be captively engaged in the clip element 43 of the mounting bracket 40 in a well recognized manner.

In addition, as shown in FIGS. 2 and 3, the interior of the magazine housing 51 is dimensioned a stick 101 of staples 100 which are urged towards the jaw elements 30 by a conventional spring loaded actuator designated generally as 55. The pivoted end 52 of the magazine housing 51 is provided with a pair of protrusions 56 which are dimensioned to be captively received in the recesses 46 in the clamp element 45 to maintain the outlet end 52 of the magazine housing 51 adjacent the location of the jaw elements 30 when the staple feeding unit 13 is disposed in its operative position as indicated by the solid lines in FIG. 2.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claims:

1. A wire mesh stapling device consisting of:

a handle unit including a pair of mirror image handle members pivotally connected to one another wherein each handle member includes an upper arm portion and a lower arm portion pivotally connected to one another wherein the upper arm portions of each handle member are pivotally connected to one another by a fastening element that functions as a pivot rod and the lower arm portions are each provided with a jaw element;

wherein each of the upper arm portions of each handle member is provided with a hand grip element, an intermediate inwardly projecting stop element and a lower inwardly projecting pivot arm; and, wherein the inwardly projecting pivot arms are pivotally secured to one another by said fastening element;

a mounting unit including an elongated mounting bracket having an upper end operatively connected to the upper arm portions of each of the handle members by said fastening element and a lower end disposed proximate the jaw elements on the lower end of the lower arm portions of each handle member wherein the lower end of the mounting unit is provided with a pair of opposed recesses; and a staple feeding unit including a staple feeding magazine having opposite ends and pivotally secured on one end to the lower end of the bracket member for feeding individual staples from a stick of staples into said jaw elements in the downwardly pivoted position and wherein the upper end of the bracket member is provided with a clip element that projects outwardly from the fastening element and is dimensioned to captively engage the other end of said staple feeding magazine in the storage position wherein said one end of the magazine is provided with a pair of protrusions that are dimensioned to be received in said pair of opposed recesses, when the staple feeding magazine is moved to an operative position.

2. The stapling device as in claim 1 wherein the lower arm portions of the handle members are operatively connected to one another by a cross piece member.

3. The stapling device as in claim 2 wherein the cross piece member is pivotally secured on its opposite ends to the lower arm portions of each handle member.

* * * * *